United States Patent [19]

Nicolinas

[11] 3,992,720

[45] Nov. 23, 1976

[54] ADJUSTABLE HEADBAND

[76] Inventor: John Nicolinas, 3390 Nanaimo St., Vancouver, B.C., Canada, V5N 3G6

[22] Filed: Dec. 29, 1975

[21] Appl. No.: 645,026

[52] U.S. Cl. ..... 2/418; 3/8

[51] Int. Cl.[2] ..... A42B 3/00

[58] Field of Search ..... 2/3 R, 3 A, 3 B, 3 C, 2/7, 8

[56] References Cited

UNITED STATES PATENTS

| | | | |
|---|---|---|---|
| 2,503,432 | 4/1950 | Bowers | 2/8 |
| 2,511,234 | 6/1950 | Anderson | 2/8 |
| 2,747,191 | 5/1956 | Hoffmaster | 2/8 |
| 3,079,609 | 3/1963 | Hoffmaster | 2/8 |
| 3,329,968 | 7/1967 | Gordon | 2/3 R |
| 3,513,481 | 5/1970 | Nickerson | 2/3 A |
| 3,787,894 | 1/1974 | Goodman | 2/3 A |

*Primary Examiner*—Alfred R. Guest

*Attorney, Agent, or Firm*—Roy E. Mattern, Jr.

[57] ABSTRACT

A headband for protective head gear is provided at opposite ends with overlapping members formed of a stiffer material than the band itself. These extension members are made adjustable longitudinally with respect to one another by means of a tensioning arrangement and a lug is provided on each member which allows tension to be applied to the headband by the fingers of one hand of the wearer of the head gear. A lever associated with the tensioning means is actuated with one finger to release the head-clamping pressure of the band.

3 Claims, 5 Drawing Figures

Fig. 1.
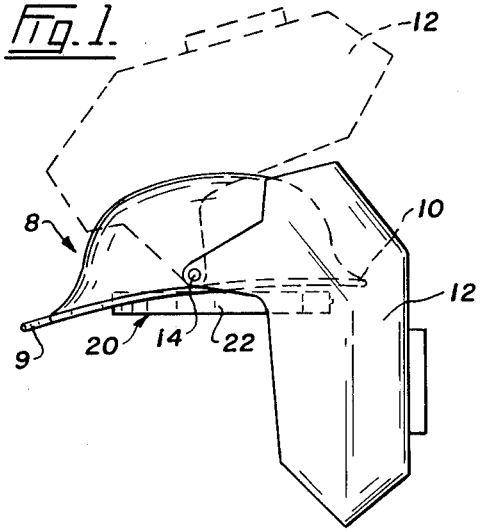
Fig. 2.
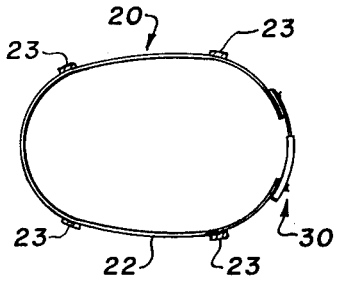
Fig. 3.
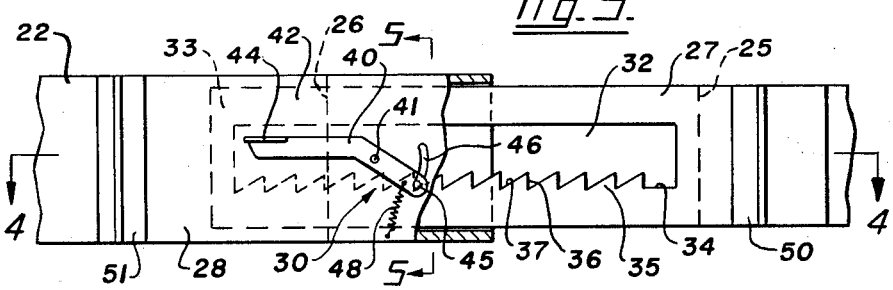
Fig. 4.
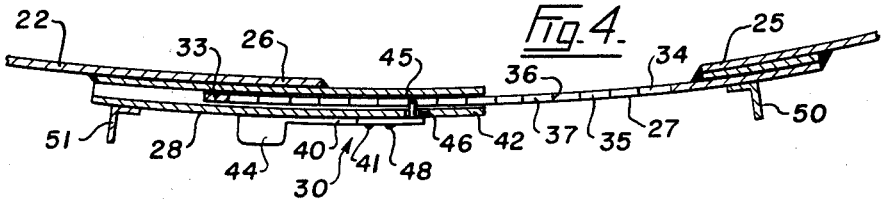
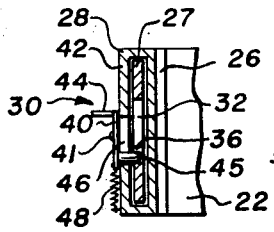
Fig. 5.

ADJUSTABLE HEADBAND

My invention relates to adjustable headband for protective head gear and more particularly to headbands for hard hats such as are worn by workmen.

A hard hat must fit snugly if it is to remain on the head of an active wearer and some provision is made on most well-constructed hats for the headband to be adjustable to a desired size. This adjustment is done by the individual workman whose first consideration, naturally enough, is with regard to comfort so that normally the band is undertightened. During normal activity on the job, the hat may stay in place when the headband is slightly loose but, if an unusual amount of bending and so on must be done by the workman, then it becomes necessary for the wearer to stop and readjust the band. Since it takes time to increase and subsequently decrease the tension of conventional headbands, the procedure is objected to my most workman whose occupation requires them to wear protective head gear.

I overcome the above mentioned as well as other disadvantages by providing a headband which will allow minimum tension to be applied so that the hat can be worn in comfort most of the time. The tension can be quickly and easily increased whenever the job dictates that the hat be tightly clamped to the head and this can be done with the fingers of one hand and while the hat remains on the head. The increased pressure is releasable by the simple flip of a lever and again there is no need for the workman to waste valuable time in removing his hat for such readjustment.

More specifically, the present invention contemplates an adjustable headband for a hard hat which comprises a flexible strap secured to the hat and having opposite ends, a relatively rigid extension member at each opposite end of the strap arranged to partially overlap longitudinally in an area accessible to the fingers of a wearer of the hat, and tensioning means for tightening the strap around the head of the wearer, said tensioning means including a plurality of teeth on one extension member, a lever pivotally secured to the other extension member and having a teeth-engaging part, and spring means biasing the part towards the teeth whereby a selected tension can be applied to the strap by manually increasing the overlap of the extension members.

In drawings which illustrate a preferred embodiment of the invention,

FIG. 1 is a side elevation of a worker's hat fitted with an adjustable headband in accordance with the present invention, FIG. 2 is a plan view of the present headband, FIG. 3 is an enlarged elevation showing tensioning means of the headband, FIG. 4 is a horizontal section taken on the line 4—4 of FIG. 3, and FIG. 5 is a vertical section taken on the line 5—5 of FIG. 3.

Referring to the drawings, the numeral 8 appearing in FIG. 1 indicates generally a hat of the type commonly worn by workman to protect them from head injuires such as might be caused by falling objects and the like. The hard hat 8 is shown as having a peak 9 and a rearwardly projecting brim portion 10. A hard hat is often fitted with a welder's face mask 12. This mask is shown mounted on laterally projected trunnions 14 carried by the hat so that it can be tilted back off the face to the out-of-the-way position illustrated in FIG. 1. Such a face mask, of course, adds considerably to the weight of the headgear and makes it more necessary than ever to provide adequate means for holding the hat against being dislodged from the wearer's head. However, a worker's hard hat without a face mask still requires some means for securely attaching it to the head and so do such other protective helmets as those used by baseball players as well as other athletes.

The numeral 20 indicates generally an adjustable headband constructed in accordance with the present invention. This band includes a strap 22 which is sewn or otherwise secured to the lower end of hanger strips 23, the strips being part of a conventional liner (not illustrated otherwise) which is suitably fastened to the inside of the hat. Strap 22 is formed of a flexible material and is supported by the strips 23 so as to pass around the head immediately above the ears whereby ends 25 and 26 of the strap are spaced apart behind the ears of the wearer.

Secured to the strap ends 25 and 26 respectively are extension members 27 and 28. Member 27 comprises a rectangular tongue of plastic or lightweight metal which is not as flexible as the material used to form the strap 22. Member 28 is constructed of plastic or other material similar to the member 27 and the former member is shaped as a rectangular and open-ended sleeve as can best be seen in FIG. 5. Thus, the member 27 is adapted to overlap and be telescopically received within the sleeve 28 so as to slide freely longitudinally therein unless held by tensioning means generally indicated at 30. The members 27 and 28 are located at the back of the head when the hard hat alone is being worn since this part of the headband is the most accessible to the fingers. When a face mask is fitted to such a hat, many welders prefer to reverse the hat on their heads to avoid interference from its peak 9, hence the relative positions of the hat and mask shown in FIG. 1. The members 27 and 28 are then over the forehead and the mask is tilted back to expose the members.

As shown best in FIGS. 3, 4 and 5, the means 30 is shown to comprise a rectangular slot 32 which is formed in the tongue 27, this slot terminating near free end 33 of the extension member. One normally horizontal edge 34 of the slot 32 has teeth 35 formed thereon. The teeth 35 are shaped to provide stop edges 36, which are perpendicular to the horizontal edge 34 of the slot, as well as inclined edges 37 which are disposed at acute angles to the stop edges.

The tensioning means 30 also includes a lever 40 which is secured by a pivot pin 41 to front wall 42 of the sleeve. On one end of the lever 40 there is a forwardly projecting finger rest 44 and the opposite end of said lever carries a latch pin 45. This pin projects through an arcuate slot 46 formed in the wall 42 of the sleeve so as to engage the teeth 35. A spring 48 connects the lever 40 to a part of the sleeve so that the latch pin 45 is continuously biased towards the teeth.

It will be apparent from the description of the latching means 30 that the device operates somewhat in the manner of a ratchet which will allow the tongue-like member 27 to be telescoped into the sleeve-like member 28 but not be withdrawn therefrom unless the lever 40 is actuated. To facilitate movement of the tongue into the sleeve, the member 27 is fitted with a lug 50. This lug is provided on the member near the end 25 of the strap so as to project outwardly at right angles to the tongue member. A similar lug 51 is provided on the sleeve member 28. The span between the lugs 50 and 51 is such that both can be conveniently gripped between the thumb and forefinger of one hand.

In use, the wearer places the hat 8 on his head and with one hand tightens the band 20 sufficiently to keep the protective helmet in place during normal working activity but without the band being uncomfortably tight. The work being performed occasionally may involve a lot of bending, for example, a welder wearing the gear shown in FIG. 1 may be required to bend over a workpiece and it is then that the headband 20 is tightened further. This can be done again with one hand and using the fingers thereof to grip the lugs 50 and 51 and apply pressure to slide the tongue into the sleeve. The pin 45 on the lever rides up the inclined edges 37 of the teeth as this is done and drops into contact with the vertical edges 36. When the clamping pressure is removed, the spring 48 pulls the pin 45 against a stop edge 36 whereupon the headband is locked in its tightened position. The workman can then move about without danger of losing his hat and even the weight of the welder's helmet will not dislodge the hat should the welder bend forward to the job as he often is required to do.

When the worker completes the job which requires that his hat be tightly clamped to his head he may elect to loosen the band so as to make the hat more comfortable to wear. This is done by applying a downward pressure of very short duration to the finger rest 44 of the lever whereupon the band will extend before again being held by the latch pin and ratchet teeth arrangement.

From the foregoing, it will be apparent I have provided a headband for a hard hat or the like which can be readily adjusted as to size while the hat is being worn and whenever the wearer decides it would be expedient to do so as dictated by the type of work engaged in. The wearer does not have to down tools to make the adjustment but merely reaches up and with two fingers applies the required tension which can later be released simply by momentarily depressing the lever.

What I claim is:

1. An adjustable headband for a hat comprising a flexible strap secured to the hat and having opposite ends, a relatively rigid extension member at each opposite end of the strap arranged to partially overlap longitudinally in an area accessible to the fingers of a wearer of the hat, and tensioning means for tightening the strap around the head of the wearer, said tensioning means including a plurality of teeth on one extension member, a lever pivotally secured to the other extension member and having a teeth-engaging part, and spring means biasing the part towards the teeth whereby a selected tension can be applied to the strap by manually increasing the overlap of the extension members.

2. An adjustable headband as claimed in claim 1, and including an outwardly projecting lug on each extension member graspable by the fingers of the hat wearer.

3. An adjustable headband for a hard hat comprising a flexible strap secured to the hat and having opposite ends, a relatively rigid tongue on one of said opposite ends, a relatively rigid sleeve on the other of said opposite ends, said tongue slidably projecting into the sleeve and having a longitudinal groove, a plurality of teeth on a side edge of the longitudinal groove, said teeth each having a stop edge and a sloping edge, a lever pivotally mounted on the sleeve and having a latch pin extending transversely across the teeth, spring means biasing the lever normally to retain the latch pin in contact with the teeth, said latch pin traversing the sloping edges when the tongue and sleeve are manually telescoped to apply selected tension to the strap and said pin engaging a stop edge to lock the tongue within the sleeve when the tensioning pressure is removed.

* * * * *